US006405716B2

(12) United States Patent
Braun et al.

(10) Patent No.: US 6,405,716 B2
(45) Date of Patent: Jun. 18, 2002

(54) FUEL FEED MODULE FOR A MOTOR VEHICLE

(75) Inventors: Hans-Peter Braun, Renfrizhausen; Dieter Schreckenberger, Marbach, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/740,441

(22) Filed: Dec. 19, 2000

(30) Foreign Application Priority Data

Dec. 21, 1999 (DE) ..... 299 22 325 U

(51) Int. Cl.[7] ..... F02M 37/10
(52) U.S. Cl. ..... 123/509; 123/510; 137/574
(58) Field of Search ..... 123/510, 497, 123/509, 514, 516; 137/565.01, 572, 574, 576

(56) References Cited

U.S. PATENT DOCUMENTS 4,776,315 A * 10/1988 Greiner ..... 123/509
6,073,614 A * 6/2000 Kleppner ..... 123/509

FOREIGN PATENT DOCUMENTS

DE 196 19 992 A1 11/1997

* cited by examiner

*Primary Examiner*—Tony M. Argenbright
(74) *Attorney, Agent, or Firm*—Michael J. Striker

(57) ABSTRACT

A fuel feed module for a motor vehicle has a storage container adapted to be arranged in a fuel supply tank of a motor vehicle, a feed aggregate arranged in the storage container and having a drive formed as an electric motor for driving fuel from the storage container to an internal combustion engine of a motor vehicle, means forming at least approximately hollow cylindrical receptacle arranged on the storage container, formed so that the feed aggregate is insertable into the receptacle in direction of its longitudinal axis, at least one mounting element fixed in the feed aggregate in direction of its longitudinal axis, the mounting element being formed as a cover part arranged on the feed aggregate and being at least partially electrically conductive.

5 Claims, 2 Drawing Sheets

FUEL FEED MODULE FOR A MOTOR VEHICLE

BACKGROUND OF THE INVENTION

The present invention relates to a fuel feed module for a motor vehicle.

One of such fuel modules is disclosed for example in the German patent document DE 196 19 992. This fuel module has a storage container arranged in a supply tank of the motor vehicle, and a feed aggregate arranged in it. The feed aggregate has an electric motor as a drive, and it supplies fuel from the supply tank to the internal combustion engine of the motor vehicle. At least approximately hollow-cylindrical receptacle for the feed aggregate is arranged on the storage container, and the feed aggregate is inserted in it. The feed aggregate is fixed in the receptacle by a mounting element, at least approximately in direction of its longitudinal axis. The mounting element is formed by a pressure connection piece which is placed on a pressure pipe of the feed aggregate. It is formed specially to perform simultaneously the mounting function. The pressure pipe is arranged near the edge of the feed aggregate, so that with the pressure connection piece fitted on it, the feed aggregate is fixed at one side in the receptacle. It is known that during the operation of the feed aggregate, electromagnetic disturbing radiation is generated by its electric motor. It must be screened by corresponding measures.

SUMMARY OF THE INVENTION

Accordingly, it is an object of present invention to provide a fuel feed module for a motor vehicle which avoids the disadvantages of the prior art.

In keeping with these objects and with others which will become apparent hereinafter, one feature of present invention resides, briefly stated, in a fuel feed module in which the mounting element is formed as a cover part which is arranged on the feed aggregate and is at least partially electrically conductive.

When the fuel feed module is designed in accordance with the present invention, it has the advantage that, due to the cover part, a reliable, simultaneous fixing of the feed aggregate in the receptacle is obtained. Moreover, because of the electrically conductive structure of the cover part, a screening of the disturbing radiation generated by the electric motor of the feed aggregate is provided.

In accordance with a further feature of the present invention the feed aggregate has at least approximately tubular housing, in which the electric motor is arranged, and the cover part is mounted by a flange connection in the housing of the feed aggregate. With this construction a simple mounting of the cover part on the feed aggregate is possible.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
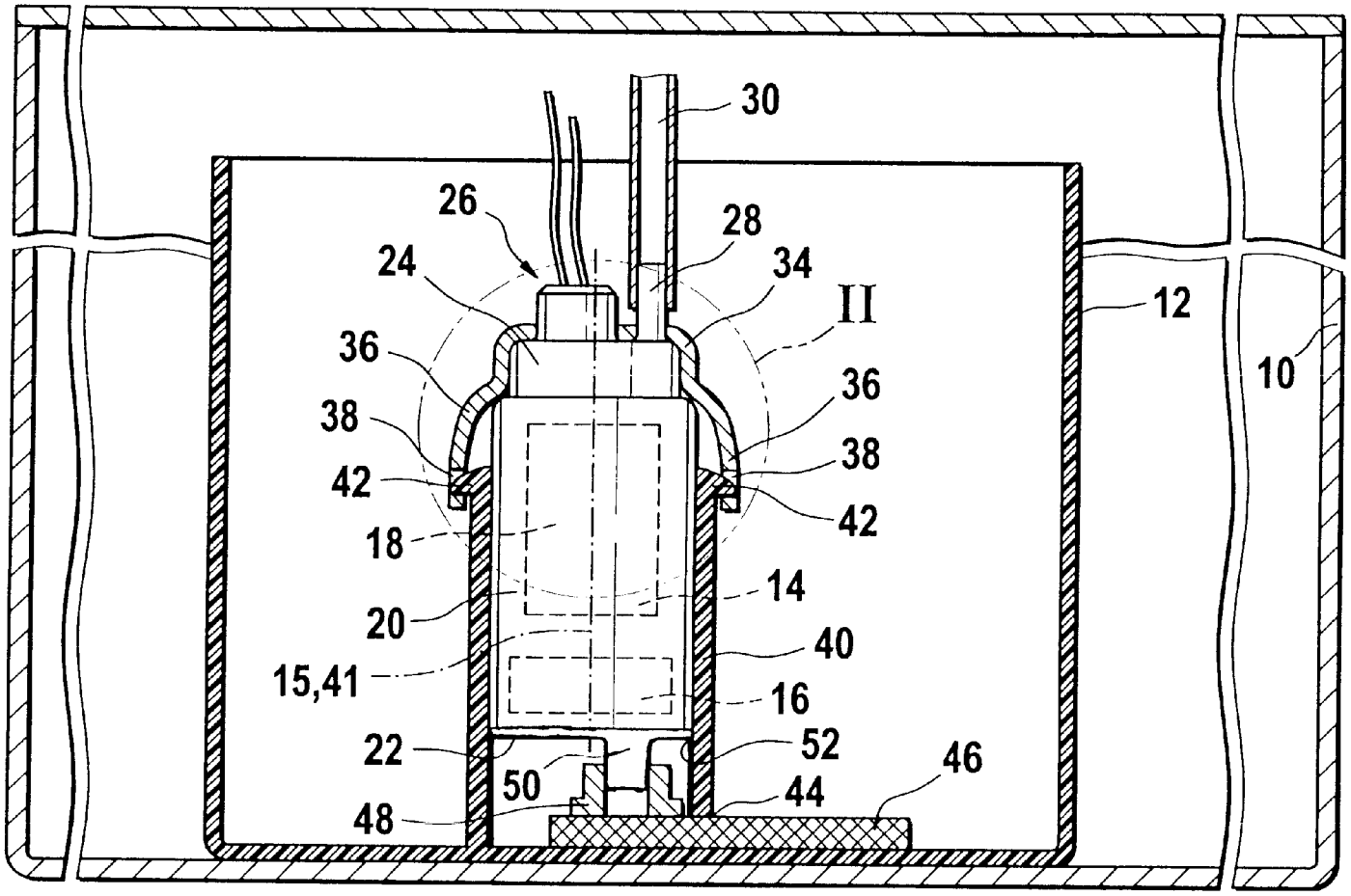
FIG. 1 is a view showing a fuel feed module for a motor vehicle in accordance with the present invention, in a schematic representation.
Figure 2:
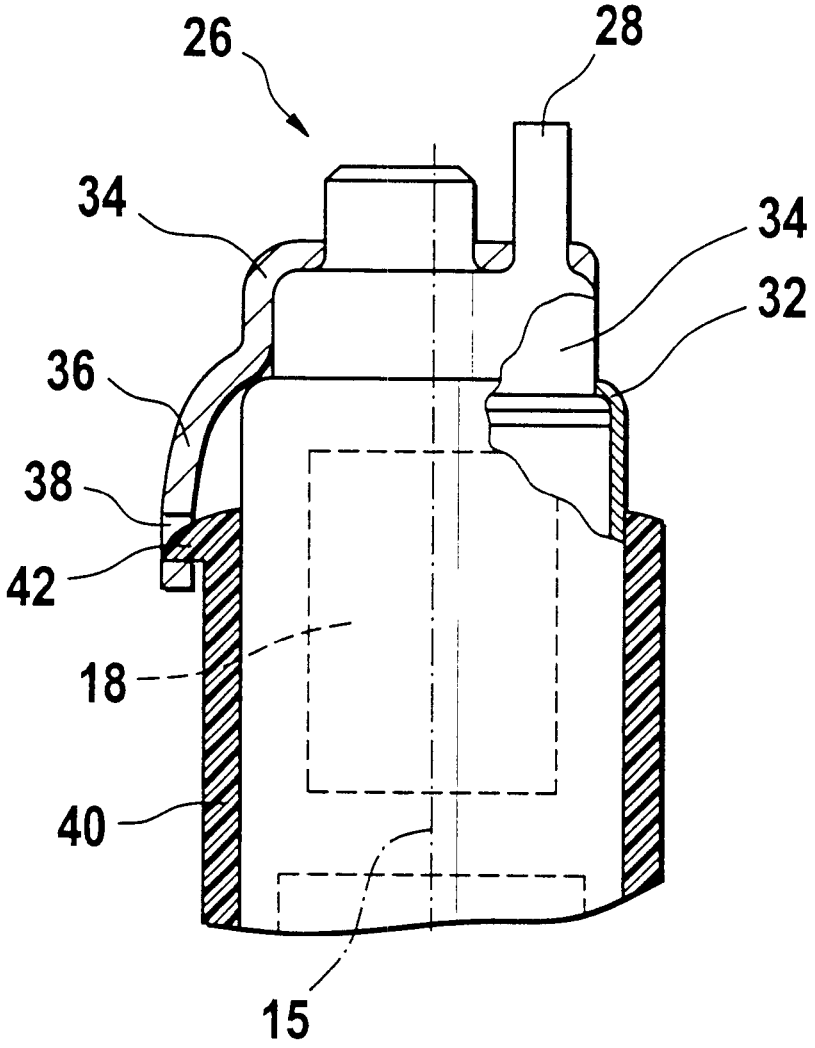
FIG. 2 is a view showing a section of the fuel feed module in accordance with the present invention, on an enlarged scale and in a section identified as II in FIG. 1.

A fuel feed module for a motor vehicle shown in FIGS. 1 and 2 has a storage container 12 arranged in a fuel supply tank 10 of the motor vehicle. It has a volume substantially smaller than the volume of the supply tank 10.

The storage container 12 is composed for example of a fuel-resistant synthetic plastic and can be produced by injection molding. The storage container 12 is fitted on a bottom of the supply tank 10 and held in a not shown manner in the supply tank. A feed aggregate 14 is arranged in the storage container 12. Fuel is fed by it from the storage container 12 to an injection device of an internal combustion engine of the motor vehicle. Fuel is fed from the supply tank 10 in the storage container 10, for example by a suction jet pump 13, so that in the storage container 12 always a sufficient fuel volume is available, from which the feed aggregate 14 can suck the fuel.

The feed aggregate 14 has a pump part 16 and a drive part 18 which are arranged in a joint, at least approximately tubular housing 20. The tube part 16 and the drive part 18 are arranged near one another in direction of the longitudinal axis 15 of the feed aggregate 14. The pump part 16 can be formed, for example as a flow pump. The drive part 18 is formed as an electric motor, by which an impeller of the pump part 16 is driven in a rotary movement. The feed aggregate 14 is closed by a cover 22 at a suction side, where the pump part 16 is arranged. It is also closed by a cover 24 at the pressure side, at which the electric motor 18 is arranged.

Electrical terminals 26 are arranged on the cover 24 for the electric motor 18 and a pressure pipe 28, through which fuel fed from the feeding aggregate 14 exits and is fed through a conduit 30 fitted on the pressure pipe 28 to the internal combustion engine. The housing 20 of the feed aggregate 14 is composed, for example, of metal and a cover 22 and 24 can be composed of synthetic plastic. The cover 22, 24 are mounted, for example, by a flange connection in the housing 20. The edge 32 of the housing 20 which extends over one of the covers 22, 24 is flanged inwardly over the cover 22, 24.

A further cover part 34 is connected with the feed aggregate 14 as shown in FIG. 2. It is arranged over the cover 24 with the electrical connection 26 and the pressure pipe 28. The cover part 24 is composed at least partially, preferably completely, of an electrically conductive material, for example metal. The cover part 34 has a cup-like shape corresponding to the contour of the cover 24. Therefore, the cover part 34 tightly closes the cover 24. The cover part 34 has openings for passage of the electrical connections 26 and the pressure pipe 28.

The cover part 34 is mounted, preferably together with a cover 24, on a housing 20 of the feed aggregate 14. First the cover 24 is inserted in the housing 20 and over it the cover part 34, and the edge 32 of the housing 20 is flanged inwardly over the cover part 34. Thereby the cover part 34 and the cover 24 are held together. Several arresting arms 36 extend from the cover part 34 and over its periphery in a distributed way. They extend along the housing 20 of the feed aggregate 14. The arresting arms 36 have an opening 38 or depression in their free end regions which face away from the cover part 34. The cover part 34 forms a screening for the electromagnetic disturbing radiation produced during the operation of the feed aggregate 14 by the electric motor 18.

The storage container 12 is arranged in a receptacle 40 for the feed aggregate 14, and is inserted in it. The receptacle 40 is formed at least approximately hollow-cylindrical, in correspondence with the shape of the feed aggregate 14. Its longitudinal axis 41 in a mounted condition in the supply tank 20 extends at least approximately vertically. The receptacle 40 is preferably formed of one-piece with the storage container 12. On the upper edge of the receptacle 40, several projections 42 extend outwardly from it over the periphery. They are distributed in a number and arrangement in correspondence with the arresting arms 36 of the cover part 34. In its lower edge region, the receptacle 40 in its casing has an opening 40 to a bottom of the storage container 12. A filter 46 passes through the opening. The filter 46 has a connecting piece 48 located inside the receptacle 40. It is fitted with the connecting piece on a suction pipe 50 on the cover 22 of the feed aggregate 14.

The feed aggregate 14 is inserted from above into the receptacle 40. The cross-section of the receptacle 40 is only a little greater than the cross-section of the feed aggregate 14, so that the feed aggregate 14 is fixed in the receptacle radially to its longitudinal axis 15. A ring shoulder 52 which faces upwardly can be formed in the receptacle 40, for example by a transverse reduction. It comes to abutment against the feed aggregate 14 in its end position. The arresting arms 36 of the cover part 34 of the feed aggregate 14 engage the receptacle 40 at its outer side, and simultaneously on the projection 32 of the receptacle 40. In the end position of the feed aggregate 14, the projections 42 engage in the openings of the arresting arms 36, so that the feed aggregate 14 is fixed in direction of its longitudinal axis 15 in the receptacle 40.

It will be understood that each of the elements described above, or two or more together, may also find a useful application in other types of constructions differing from the types described above.

While the invention has been illustrated and described as embodied in a fuel feed module for a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel feed module for a motor vehicle, comprising a storage container adapted to be arranged in a fuel supply tank of a motor vehicle; a feed aggregate arranged in said storage container and having a drive formed as an electric motor for driving fuel from said storage container to an internal combustion engine of a motor vehicle; means forming at least approximately hollow cylindrical receptacle arranged on said storage container, formed so that said feed aggregate is insertable into said receptacle in direction of its longitudinal axis; at least one mounting element fixed in said feed aggregate in direction of its longitudinal axis, said mounting element being formed as a cover part arranged on said feed aggregate and being at least partially electrically conductive.

2. A fuel feed aggregate as defined in claim 1, wherein said cover part is formed at least partially of metal.

3. A fuel feed aggregate as defined in claim 1, wherein said feed aggregate has at least approximately tubular housing in which said electric motor is arranged, said cover part being mounted in said housing of said feed aggregate by a flanged connection.

4. A fuel feed aggregate as defined in claim 2, wherein said feed aggregate has at least approximately tubular housing in which said electric motor is arranged, said cover part being mounted in said housing of said feed aggregate by a flanged connection.

5. A fuel feed aggregate as defined in claim 1, wherein said cover part has a plurality of arresting arms projecting over its periphery and extending from the periphery so as to engage said receptacle and to arrest on said receptacle.

* * * * *